United States Patent [19]

Chen et al.

[11] 4,420,784

[45] Dec. 13, 1983

[54] HYBRID D.C. POWER CONTROLLER

[75] Inventors: C. Gregory Chen, Brown Deer; Ping S. Lee, Milwaukee; Peter J. Theisen, West Bend; Slobodan Krstic, Milwaukee, all of Wis.

[73] Assignee: Eaton Corporation, Cleveland, Ohio

[21] Appl. No.: 327,388

[22] Filed: Dec. 4, 1981

[51] Int. Cl.[3] ..... H01H 33/14

[52] U.S. Cl. ..... 361/7; 361/13

[58] Field of Search ..... 361/4, 7, 8, 13, 14

[56] References Cited

U.S. PATENT DOCUMENTS

| | | | |
|---|---|---|---|
| 2,789,253 | 4/1957 | Vang | 361/4 |
| 2,970,196 | 1/1961 | Reagan | 361/14 X |
| 3,309,570 | 3/1967 | Goldberg | 361/4 |
| 3,430,016 | 2/1969 | Hurtle | 361/13 X |
| 3,558,977 | 1/1971 | Beaudoin | 361/13 X |
| 4,056,836 | 11/1977 | Knauer | 361/4 |
| 4,110,806 | 8/1978 | Murano et al. | 361/4 |
| 4,172,268 | 10/1979 | Yanabu et al. | 361/4 |
| 4,216,513 | 8/1980 | Tokuyama et al. | 361/13 |
| 4,249,223 | 2/1981 | Shuey et al. | 361/4 |
| 4,375,021 | 2/1983 | Pardini et al. | 200/147 B |

OTHER PUBLICATIONS

High Voltage DC Switching, SAE-2Y HVDC Power Panel Meeting No. 7, May, 1981, Title page & pps. 1–27, by Edward Gray.

*Primary Examiner*—Harry E. Moose, Jr.

*Attorney, Agent, or Firm*—C. H. Grace; W. A. Autio

[57] ABSTRACT

A hybrid D.C. power controller of the relay/circuit breaker type that uses a hybrid arrangement of hard contacts (4) and power FET's (18, 20) in cooperative functional combination as the arc quenching means for 270 volt D.C. power systems in low atmospheric pressure environments such as at 80,000 feet altitude in aircraft applications. Also, the relay is provided with arc horns (44*c*, 48*b*, 48*c*, 46*c*), magnetic field amplifiers (60, 62) looped stationary contacts (44, 46), arc splitters (64, 66), and gas ablating insulating members (60*b*, 62*b*, 72, 74, 64*b*, 66) to enable the relay to interrupt the power circuit if necessary without the help of the power FET's. The power FET's are controlled in both opening and closing the power circuit to afford arcless contact operation in normal load make-break situations. Current and voltage sensing (28, 32) and sampling (CS, VS) circuits determine when to turn the power FET's on after contact arcing has provided the required values. The power contacts (4) can be closed and opened by manual switch (TS) control and opened automatically under overload or short circuit conditions by instantaneous trip detector (ITD) control. Isolation contacts (2) in the power circuit are controlled by delay means (MMV4, MMV8) to close last and open first with respect to the power contacts.

19 Claims, 10 Drawing Figures

270 V. D.C.
+V
24
VP
26
BF1
V2
28
R1
R2
CPR1
VI
30
V1
R3
R4
BF2
+V
VP0
POT1
30a
MMV2
4098
MONO
80
V3
EC
LCH1
4043
S
R
Q
VI
+V
CPR2
POT4
160A.
CS
I1
A1
01
A2
CPR3
I2
POT5
300A.
A3
CVSC
78
76
VFET
32
R5
BF3
VF
34
+V
CPR4
VS
R6
ZD1
POT2
12V.
POT3
30V.

+V
82
+VC
6
RC
RCC
R10
MMV4
MMV5
4098
4098
14a
8
4093
FET4
ZD3
R9
NA1
10
V5
A4
NA2
I3
TS
OPEN
CLOSE
+VC
ICC
14b
ZD2
FET3
V3
IC
MMV3
MMV11
4098
4098
96
ROC
RO
+VC
14c
IOC
86
FET5
ZD4
MMV7
14d
+VC
84
4098
FET6
IO
MMV8
MMV9
4098
4098
ZD5
88
+V
LED
FET7

V3
TIC
I5
A6

HYBRID D.C. POWER CONTROLLER

BACKGROUND OF THE INVENTION

Hybrid D.C. power controllers have been known heretofore. For example, A. Vang U.S. Pat. No. 2,789,253, dated Apr. 16, 1957, L. J. Goldberg U.S. Pat. No. 3,309,570, dated Mar. 14, 1967, W. Knauer U.S. Pat. No. 4,056,836, dated Nov. 1, 1977, M. Murano et al. U.S. Pat. No. 4,110,806, dated Aug. 29, 1978, S. Yanabu et al. U.S. Pat. No. 4,172,268, dated Oct. 23, 1979, S. Tokuyama et al. U.S. Pat. No. 4,216,513, dated Aug. 5, 1980, and K. C. Shuey et al. U.S. Pat. No. 4,249,223, dated Feb. 3, 1981, show circuits that discharge a previously charged capacitor across the contacts to provide arcless interrupters. Such capacitor discharge is controlled by an SCR or the like which is activated by sensing means that senses the arc, the voltage across the contacts, or the like.

While these prior current interrupters have been useful for opening a circuit, they do not provide means for assisting in interrupting a high voltage D.C. circuit at low atmospheric pressures of the order of 1 psi such as occur at high altitudes of the order of 80,000 feet or the like. This invention relates to improvements thereover.

SUMMARY OF THE INVENTION

An object of the invention is to provide improved means for interrupting a high voltage and high current D.C. power circuit.

A more specific object of the invention is to provide improved means for interrupting a high voltage, and high current D.C. power circuit at low atmospheric pressures such as occur at high altitudes in aircraft applications.

Another specific object of the invention is to provide improved means for interrupting a bidirectional high voltage and high current D.C. power circuit at low atmospheric pressures such as occur at high altitudes in aircraft applications.

Another specific object of the invention is to provide an improved high voltage and high current D.C. interrupter with an electromagnetic relay structure that will interrupt a high voltage high current circuit without the need of a solid state shunting device.

Another object of the invention is to provide an interrupter of the aforementioned type that also affords arcless closing of the D.C. power circuit.

Another specific object of the invention is to provide a gaseous environment and an induced magnetic field to accelerate low pressure arc motion.

Another specific object of the invention is to provide an improved hybrid D.C. power controller for effectively interrupting a high voltage and high current D.C. power circuit in a controlled manner that enables reducing the size, rating and number of solid state elements such as power FET's across the power contacts to a minimum.

Another specific object of the invention is to provide an improved power interrupter for a D.C. load circuit that senses the current and voltage of opened interrupter contacts and in response to a predetermined ratio thereof operates a current shunting device which thereafter is controlled to interrupt the current in the load circuit.

Another specific object of the invention is to provide a D.C. power controller with a combination of arc control devices that function in combination to effectively interrupt a high voltage D.C. circuit.

Other objects and advantages of the invention will hereinafter appear.

DESCRIPTION OF THE PREFERRED EMBODIMENT

Figure 1:
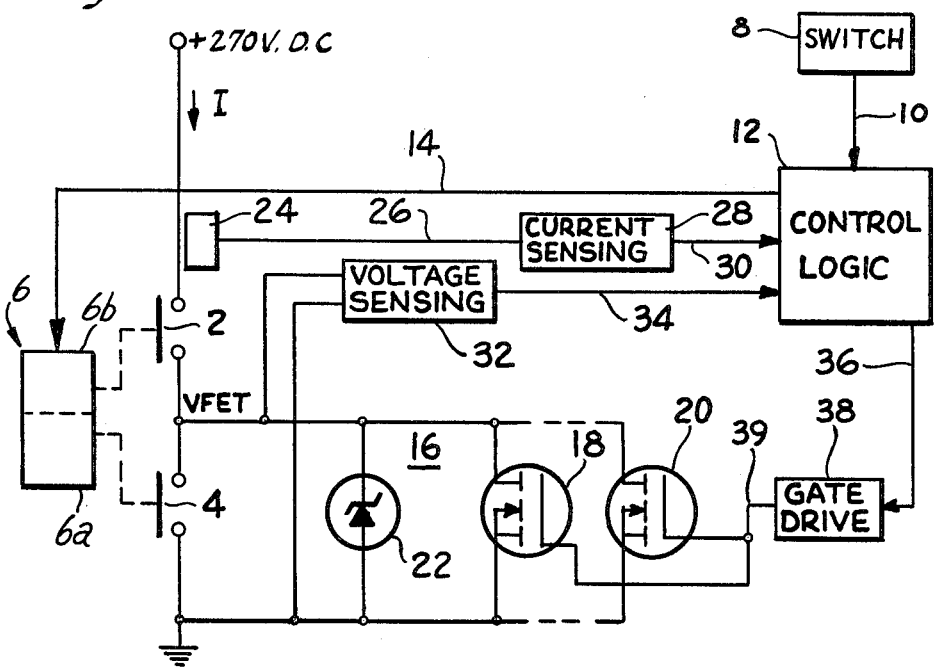
FIG. 1 is a block diagram of a hybrid D.C. power controller constructed in accordance with the invention to show the general arrangement thereof.

Referring to FIG. 1 there is shown in block diagram form a hybrid D.C. power controller constructed in accordance with the invention. As shown therein, a high voltage such as 270 volts D.C. is connected to a load, not shown, and then through isolating contacts 2 and power controlling contacts 4 to ground so that when both of these contacts are closed the load is energized. Contacts 2 and 4 are of the double break type as shown in FIG. 1 and power controlling contacts 4 are described in more detail hereinafter in connection with FIGS. 2, 3, 4 and 5. These contacts are controlled by contact operating mechanisms 6 as indicated by the broken lines, these contact operating mechanisms 6 being of the electromagnetic type or the like hereinafter more fully described in connection with the logic diagram of FIGS. 6*a–c.* These operating mechanisms may be controlled by a manual switch circuit 8. As indicated by line 10 in FIG. 1, this switch circuit acts on a control logic 12 which in turn controls the contact operating mechanisms 6 as indicated by line 14.

To aid in extinguishing the arc on power contact 4 when these contacts are opened, there is provided a current shunting circuit connected across contacts 4 as indicated generally by 16. This current shunting circuit comprises current shunting means such as one or more power FET's (field effect transistors) 18 and 20 connected in parallel with one another and across contacts 4, across stationary contacts terminals 44*b* and 46*b* in FIG. 2. While power FET's have been shown in FIG. 1 for exemplary purposes, it will be apparent that other equivalent devices for this application such as gate turn off SCR's or bipolar transistors or the like could be used in place thereof. This shunting circuit also comprises a power absorbing device 22 connected across contacts 4.

This power absorbing device 22 may be zener diode, a metal oxide varistor, or a power zener of a high speed type or the like.

In order to determine when the power FET's should be turned on, the current in the power line and the voltage across power contacts 4 are sensed. For this purpose, there is provided a current sensing device 24 adjacent the 270 volt D.C. line. While equivalent devices may be used, this current sensor 24 is preferably an electrically isolated Hall effect sensor. This current sensor is connected through line 26 and a current sensing circuit 28 and through line 30 to control logic 12. A voltage sensing circuit 32 is connected across power contacts 4 to sense the voltage across the contacts and is connected through line 34 to control logic 12. Control logic 12 acts through line 36 to control gate drive circuit 38 which in turn gates the power FET's on and off at the appropriate times.

The system shown in FIG. 1 operates generally as follows: When switch circuit 8 is actuated from its open position to its closed position, it acts on control logic 12 to operate contact operating mechanisms 6 thereby to close contacts 2 and 4. Isolating contacts 2 are closed first by operating mechanism 6*b* and then power contacts 4 are closed by mechanism 6*a*. When switch circuit 8 is moved from its closed position to its open position, power contacts 4 open first and after the shunting circuit 16 has extinguished the arc, isolating contacts 2 open. When power contacts 4 open and draw an arc, current sensor 24 senses the current in the line and voltage sensing circuit 32 senses the voltage across power contacts 4 and when the current and voltage have reached a predetermined ratio, control logic 12 activates gate drive circuit 38 to gate the power FET's and turn them on, thereby to shunt the current from the power contacts 4. After another predetermined time, power FET's 18 and 20 are turned off and any remaining energy across the contacts is absorbed by energy absorber 22, thereupon interrupting the power circuit to the load. Thereafter, isolating contacts 2 open to completely isolate the load from the power supply and to insure that there will be no leakage of current through the current shunting circuit 16.

Alternatively, power contacts 4 and isolating contacts 2 may be opened by overload or fault current conditions. Under this condition, current sensor 24 senses the current in the power line and sends a signal through line 26, current sensing circuit 28 and line 30 to control logic 12. An instantaneous trip detector or overload current detector therein detects whether the current is in a fault or an overload condition and if so, acts through line 14 to control contact operator 6 to open power contacts 4 and isolating contacts 2 in the same manner previously described.

While a unidirectional power circuit has been shown in FIG. 1, it will be apparent that a bipolar or bidirectional power circuit may be controlled with the small modification of inserting a full-wave rectifier bridge between contacts 4 on the one hand and shunting circuit 16 and voltage sensing circuit 32 on the other hand.

Figure 2:
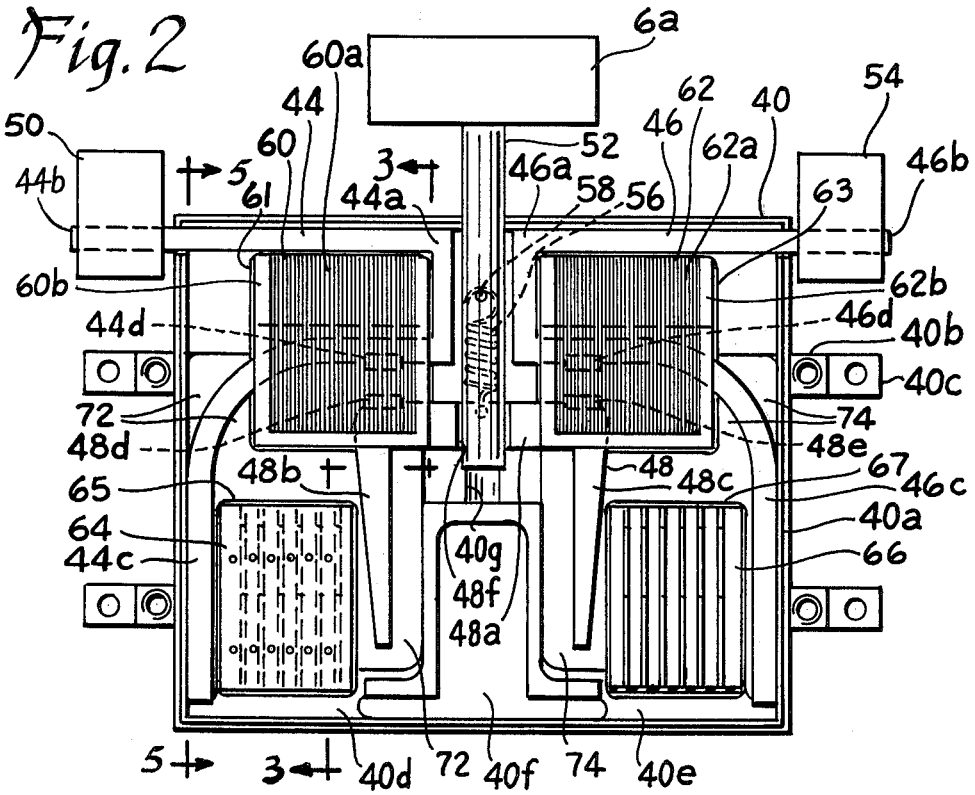
FIG. 2 is top view, with the cover removed, of an electromechanical power relay used in the hybrid D.C. power controller of FIG. 1 to show the contacts, magentic field amplifiers and arc splitters thereof.
Figure 3:
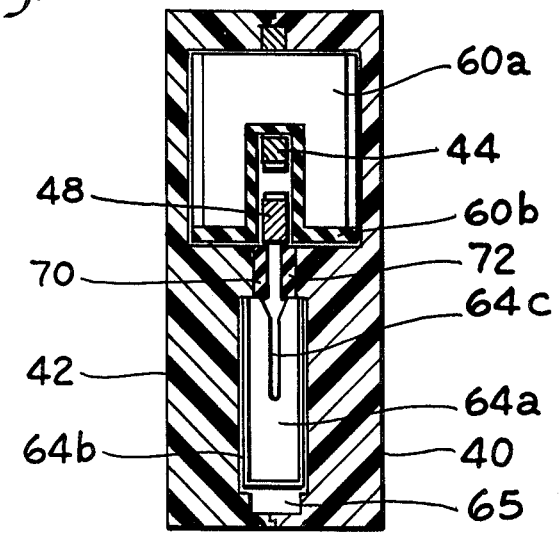
FIG. 3 is a cross-sectional view taken substantially along line 3–3 of FIG. 2 but with the cover in place, to show the contacts, magnetic field amplifiers and arc splitters from another direction.
Figure 4:
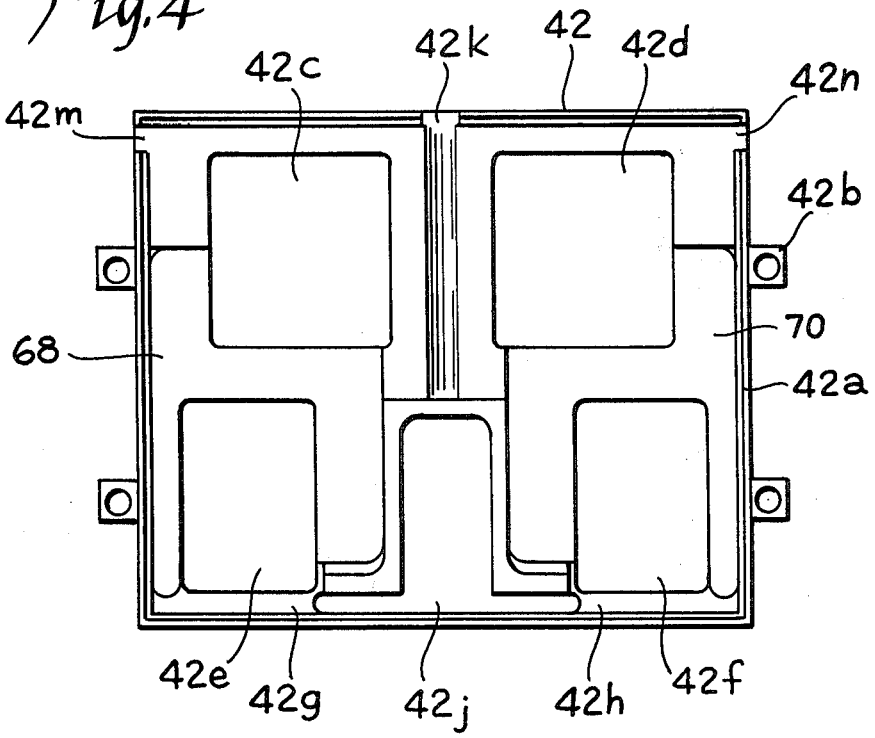
FIG. 4 is a bottom or internal view of the cover for the relay of FIG. 2 to show the pockets for the field amplifiers and arc splitters as well as the gas receiving pocket and the insulating plates.
Figure 5:
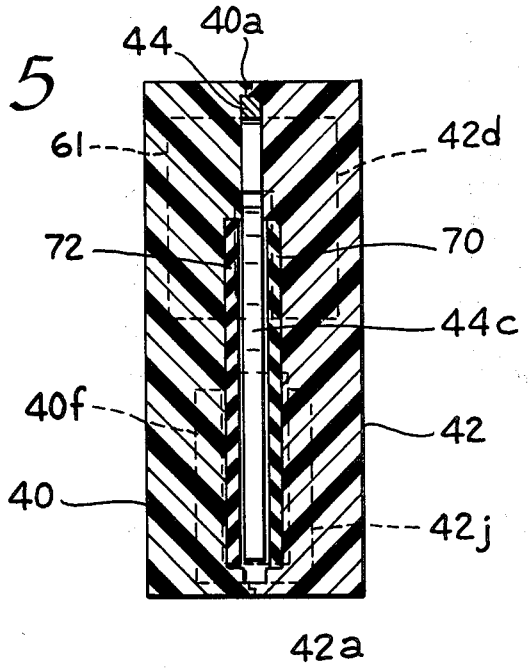
FIG. 5 is a cross-sectional view taken substantially along line 5–5 of FIG. 2 but with the cover in place, to show one stationary contact, the insulating, gas-ablative plates, and the depths of the gas pocket and field amplifier pocket.

Power contacts 4 and the operating mechanism therefore generally indicated by the lower portion 6*a* of rectangle 6 in FIG. 1 are shown in more detail in FIGS. 2–5. As shown in FIG. 2, this power control device or relay is provided with an insulating base 40 of generally rectangular form having recesses or pockets therein for the various parts. Cover 42 is shown in FIG. 4 and is generally symmetrical in shape to base 40. As shown in FIGS. 2, 4 and 5, base 40 and cover 42 have interfitting ridges and grooves 40*a* and 42*a* at their peripheral edges to make a tight fitting joint when the two parts are secured together. For this purpose, base 2 is provided with four threaded lugs 40*b* and cover 42 is provided with corresponding four perforated lugs 42*b* through which screws or the like may be threaded in engagement with the lugs on the base. Lugs 40*b* on the base also have perforated extensions 40*c* through which screws or the like may be used to attach the base to a supporting panel.

As shown in FIG. 2, the relay is provided with a pair of stationary contacts 44 and 46 and a movable bridging contact 48. Each stationary contact such as contact 44 has a generally U-shaped portion 44*a* with one leg of the U extending out through a notch in the wall of the base to provide a terminal 44*b*, and the other leg of the U being bent generally outwardly to form one side 44*c* of an arc horn or arc runner. A contact 44*d* of good electrically conducting material such as silver cadmium oxide is inlaid or welded to one side of the U-shaped portion to form a stationary contact. A wire lug 50 is attached to terminal portion 44*b* for securing an electrical conductor and the leads of the power FET's 18–20 to the stationary contact. The stationary contact 46 is similarly constructed except that it is arranged turned around in the opposite direction in spaced apart relation with stationary contact 44 to provide space therebetween for the movable contact operating shaft 52. A wire lug 54 is secured to terminal portion 46*b* of stationary contact 46 for electrically connecting the stationary contacts to the circuit such as that shown in FIG. 1.

Movable contact 48 is a generally U-shaped member having a straight yoke portion 48*a* with a pair of arms 48*b* and 48*c* extending from the opposite ends thereof in substantially parallel relation except that their outer edges are tapered to form the other sides of the arc horns with respect to members 44*c* and 46*c*, respectively. Two contacts 48*d* and 48*e* are inlaid at the opposite end portions of yoke portion 48*a* of a movable contact in opposing relation to stationary contacts 44*d* and 46*d*, respectively, so that the movable bridging contact will bridge the stationary contacts when the movable contact is actuated. Yoke portion 48*a* of the movable contact has a reduced portion 48*f* at its center where it enters a slot in the end of operating shaft 52. A tension spring 56 is retained in a bore in operating shaft 52, one end hook thereof being retained by a pin 58 extending through operating shaft 52 and the other end hook of the spring being retained in a small hole in reduced portion 48*f* of the movable contact. As shown in FIG. 2, spring 56 is in a stretched condition when the contacts are open. When the contacts are closed, this spring is stretched still further so as to provide wear allowance when the relay is used. The tension in this spring is such that while it provides wear allowance, it does not permit opening of the contacts under any magnetic forces that may be induced in the contact structure. Thus, the contacts can only be opened and closed by operating mechanism 6*a* acting through shaft 52.

The two sides of the movable and stationary contacts and portions of the arc horns are embraced by a pair of field amplifiers 60 and 62, respectively, as shown in FIG. 2. Each of these magnetic field amplifiers such as 60 comprises a stack of generally U-shaped magnetic steel plates 60*a* as shown in FIGS. 2 and 3. This stack of steel plates is housed in an insulating cover 60*b* which covers the U-shaped opposite sides of the stack as well as the inner surfaces of the U-shaped portion and the ends of the legs of the U. As shown in FIG. 3, the insulated legs of this U-shaped field amplifier underlie and overlie the opposite sides of the bridging contacts as well as portions of the arc horns. Thus, all portions of these U-shaped plates of the field amplifier that are exposed to any arcs between the contacts are lined with the insulating material. The start portions of the arc horns adjacent the contacts are preferably made of a special material, or example, copper metal hydride so as to generate hydrogen to assist in moving the arc.

A pair of arc splitters 64 and 66 are seated in pockets 65 and 67 in the base as shown in FIG. 2. Each of these arc splitters such as 64 comprises a plurality of spaced, electrically conductive ferro-magnetic metal plates 64*a* held in a generally U-shaped insulating retainer 64*b* as shown in FIGS. 2 and 3. Thus, the plates are insulated from one another and each is provided with a tapered-front, narrow slot 64*c* as shown in FIG. 3 for receiving the arc as it is moved along the arc chute or arc horn. Base 40 is provided with grooves 40*d* and 40*e* at the rear ends of the arc splitters that lead into a deeper gas receiving pocket 40*f* as shown in FIG. 2. A shallow semi-cylindrical groove 40*g* extends from one side of the base all the way to the wall of gas receiving pocket 40*f* to provide clearance for contact actuating shaft 52.

As shown in FIG. 4, cover 42 is generally symmetrical in shape to base 40 and is provided with a pair of magentic field amplifier pockets or sockets 42*c* and 42*d* and a pair of arc splitter pockets 42*e* and 42*f*. Also, grooves 42*g* and 42*h* extend from the rear ends of the arc splitter pockets along the wall of the cover toward one another and into gas receiving pocket 42*j*. In addition, a shallow semi-cylindrical groove 42*k* extends through one wall of the cover and along the cover all the way to the wall of gas receiving pocket 42*j* to provide clearance for operating shaft 52. This cover is also provided with a pair of notches 42*m* and 42*n* to provide clearance for the stationary contact extensions which form terminals at the exterior of the housing.

FIG. 5 shows in broken lines, the depths of the field amplifier pockets 61 and 42*d* in the base and cover, respectively. FIG. 5 also shows in broken lines, the depths of the gas receiving pockets 40*f* and 42*j* in the base and cover, respectively.

As shown in FIG. 4, a pair of insulating plates 68 and 70 are seated in and preferably secured in the cover and partially define the walls of the field amplifier pockets as well as the arc splitter pockets. A like pair of insulating plates 72 and 74 are seated in and preferably secured in the base as shown in FIG. 2. As will be apparent, when the cover is clamped to the base, these pairs of insulating plates completely line the surfaces of the base and cover between and around the field amplifiers and the arc splitters and sandwich the arc horns therebetween where they exit from the field amplifiers. These insulating plates are made of the same material as the field amplifier covers 60*b* and 62*b* so that whenever arcs are drawn when the contacts are open, the arcs are exposed only to this material until they enter or arc blown or moved into the arc splitters.

The magnetic field amplifier covers, the arc splitter plates' U-shaped insulating retainers and the pairs of insulating plates that hug the arc chutes are made of a material that ablates gases to provide an atmosphere in the arc chutes that is conducive to movement of the arcs into the arc splitters thereby to limit and reduce the current. An insulating material that may be used for this purpose is polyacetal resin, more popularly known as Delrin by Dupont. Acetal polymer is produced by the polymerization of formaldehyde. It has a melting point of 175° C., a breakdown temperature of 300° C. and its degradation products are mainly formaldehyde. Another material that may be used for this purpose is polyamide, more properly known as nylon-66 by Dupont.

It's melting point is 270° C., its breakdown temperature is 310° to 380° C. and its degradation products are $H_2O$, $CO_2$, cyclopentonone and hydrocarbon traces.

Past experiments by other investigators in the area of arc motion have shown that low pressure arc is very immobile. Furthermore, the arc voltage gradient is nearly almost at a constant level unless the contact gap is very large such as more than 10 cm which is unrealistic, thus implying that regardless of the contacts opening speed and the length a low pressure arc within a reasonably sized device, the arc voltage will not be increased in any significant amount. Therefore, the effort to increase arc voltage for the purpose of limiting let through fault current will not be focused on developing a large gap in the case of low pressure but instead to increase the arc mobility and velocity and utilization of arc splitting technique by an arc chute for high arc voltage build up.

It is our belief that the mobility of a low pressure arc is greatly affected by the molecular density and composition of the environment in which the arc exists. Therefore, if the insulating material is placed very close to the vicinity of an arcing path such that it will ablate a gaseous cloud, when exposed to the heat of a low pressure arc, which simulates the molecular density and composition of an atmospheric pressure environment at sea level, we then can expect the low pressure arc to move quickly away from the contact area and into the arc chute without the stalling tendency which is frequently exhibited by low pressure arc. In addition, the amplification of the existing magnetic field of a low pressure arc by the presence of a field amplifier should greatly increase the acceleration of a moving arc. Thus, the insulating material is such that it will provide a suitable environment which will eliminate low pressure arc stalling tendency. Secondly, amplification of the magnetic field by field amplifiers promotes a higher arc moving velocity. Thirdly, the combination of the above first and second will produce arc motion in a low pressure environment, therefore eliminating the need of a hermetically sealed housing for the relay.

Because of high arc mobility, the device is capable of developing a high arc voltage which will reduce the let-through fault current and consequently reducing the size, rating and the number of solid state elements in shunt of the contacts.

Figure 6A:
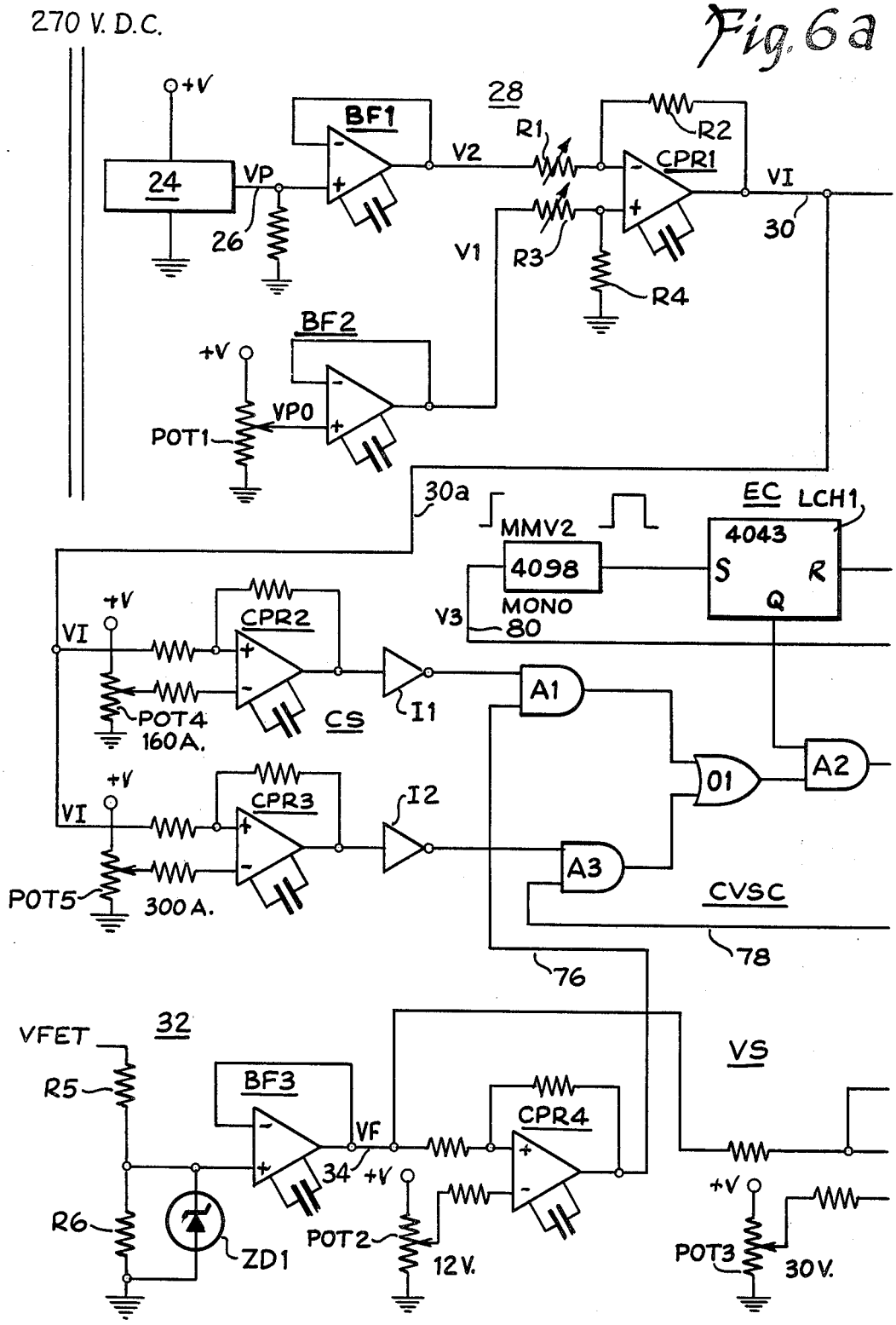
FIGS. 6*a–c,* when arranged as shown in FIG. 7, show a schematic circuit diagram of the control logic system used in the block diagram of FIG. 1.
Figure 6B:
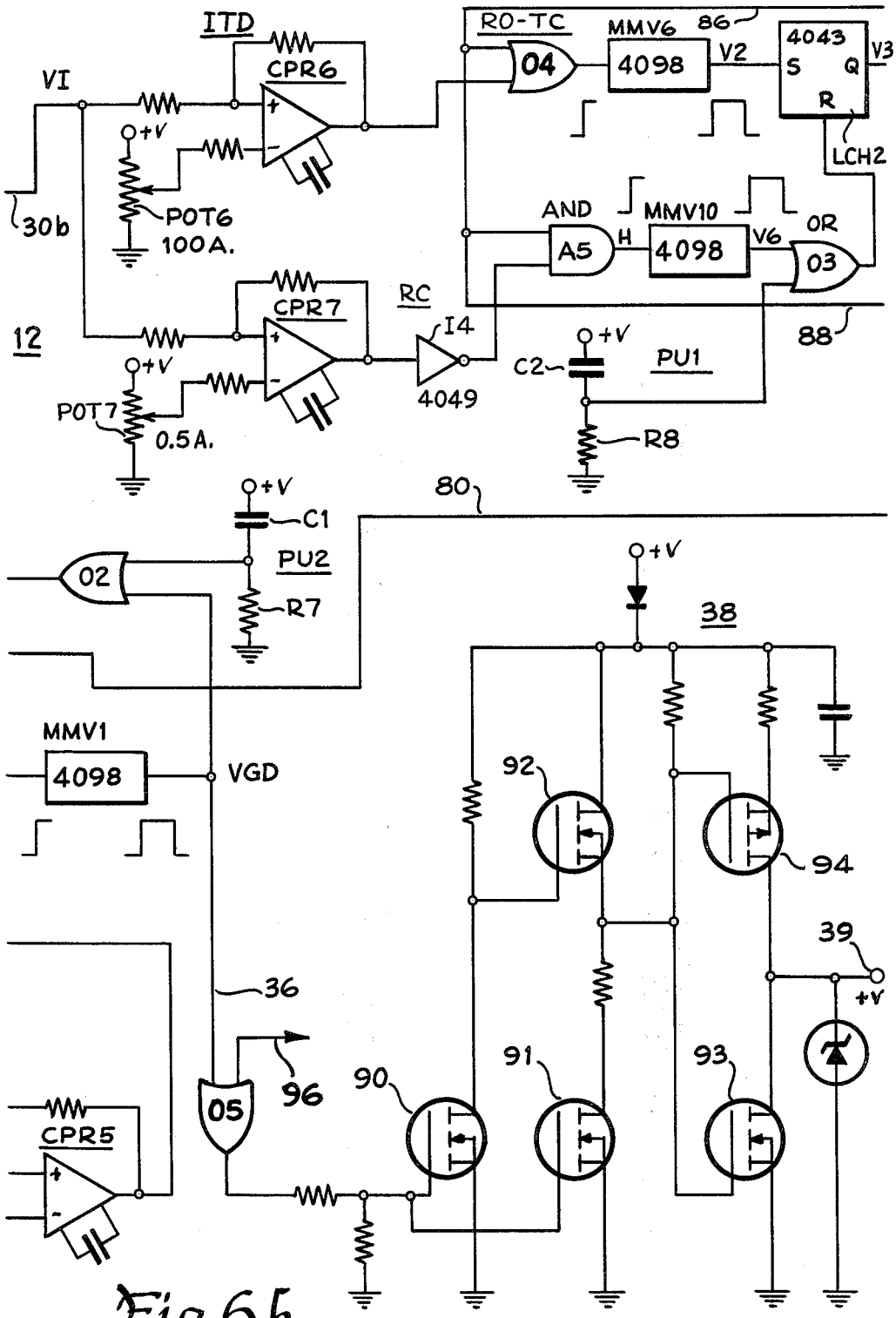
Figures 6A, 6B, 6C, 7:
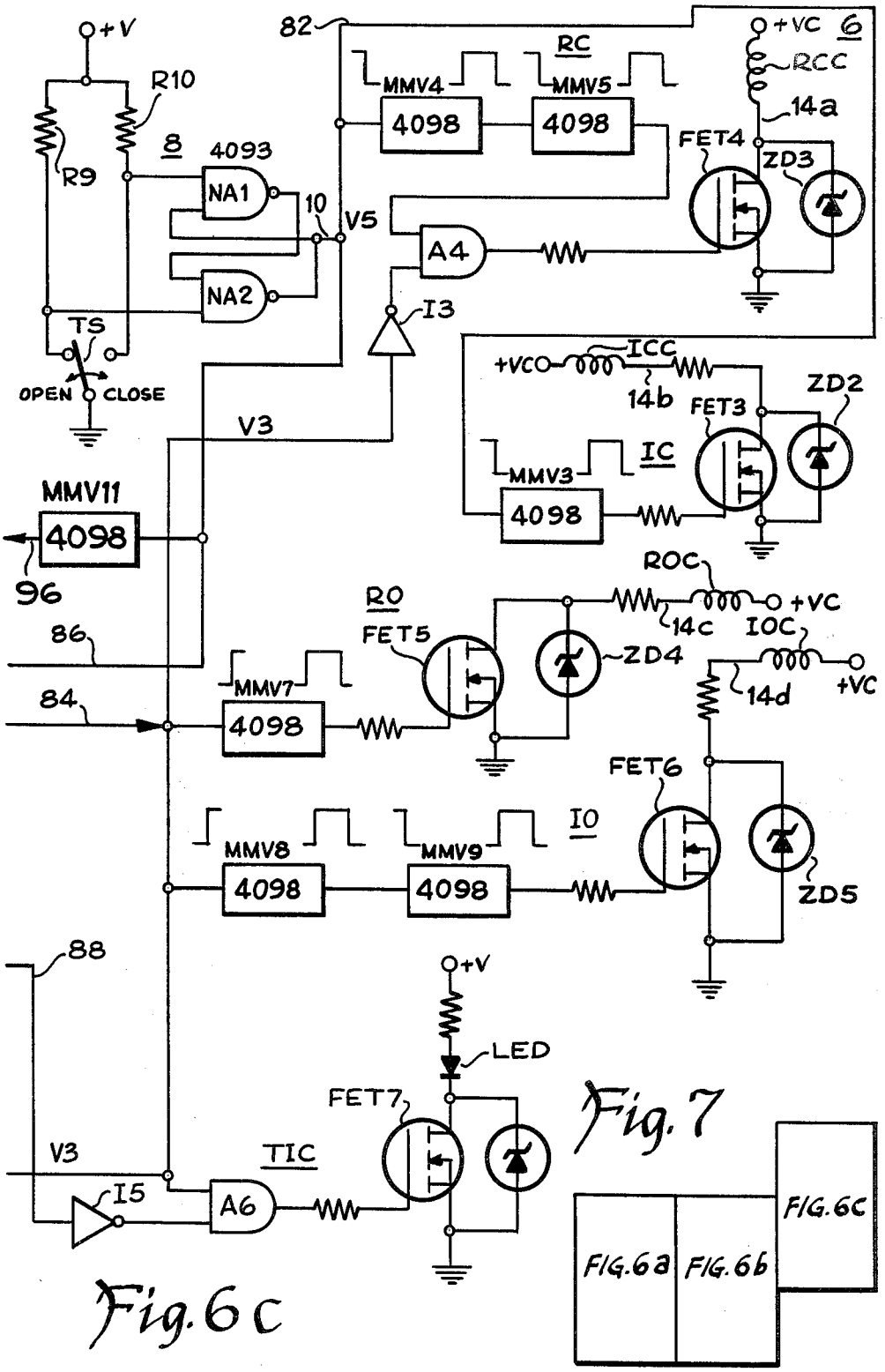

Referring to FIGS. 6*a–c* there is shown a logic circuit diagram illustrating in more detail the circuit shown in block diagram form in FIG. 1. The three sheets comprising FIGS. 6*a–c* should be assembled in the manner shown in FIG. 7 so that the right hand side of FIG. 6*a* connects with the left hand side of FIG. 6*b* and the upper right hand side of FIG. 6*b* connects with the lower left hand portion of FIG. 6*c*. Reference characters like those in FIG. 1 are generally used for like parts in FIGS. 6*a–c*. Referring to FIG. 6*c*, switch circuit 8 is shown at the upper left hand portion thereof and is connected by conductor 10 to the logic circuit hereinafter described. This logic circuit is connected at the right hand portion of FIG. 6*c* by conductors 14*a–d* to relay contacts closing coil RCC, isolation contacts closing coil ICC, relay contacts opening coil ROC and isolation contacts opening coil IOC, respectively. As will be apparent, these coils are comprised in contact operating mechanism 6 illustrated schematically in FIG. 1 and the relay contacts closing coil and the relay contacts opening coil are in portion 6*a* thereof whereas the isolation contacts closing coil and the isolation contacts opening coil are in portion 6*b* thereof.

The 270 V.D.C. power conductor is illustrated by a pair of vertical lines at the upper left hand portion of FIG. 6*a*. Also, current sensor 24 is shown adjacent thereto and is connected by a conductor 26 to the current sensing circuit indicated generally by 28 at the upper portion of FIG. 6*a*. This current sensing circuit is in turn connected by conductor 30 to the control logic 12 extending throughout FIGS. 6*a–c* and hereinafter more fully described. Voltage sensing circuit 32 is shown at the lower left portion of FIG. 6*a*. As will be apparent voltage terminal VFET at the lower left hand portion of FIG. 6*a* is connected to the similarly referenced point in FIG. 1 at the upper side of power contacts 4 so as to receive the voltage appearing at the upper side of power contacts 4 and referenced to ground. This voltage sensing circuit 32 is connected by conductor 34 to control logic 12.

Gate drive circuit 38 shown at the lower right hand portion of FIG. 6*b*, has an output terminal 39 whereby it may be connected to the gates of power FET's 18 and 20 in FIG. 1. While only two power FET's are shown for exemplary purposes in FIG. 1, it is contemplated that one or more than two power FET's may be used as indicated by the broken lines between power FET's 18 and 20 in FIG. 1 depending upon the current that must be handled as hereinafter more fully described. Gate drive circuit 38 receives its input control signal along conductor 36 as shown at the lower portion of FIG. 6*b*.

The remainder of the logic circuits in FIGS. 6*a–c* constitute the control logic indicated in block 12 in FIG. 1. This control logic comprises in FIG. 6*c* a relay closing control circuit RC at the upper portion of the FIG. 6*c* and isolation contacts closing circuit IC therebelow, a relay opening control circuit RO therebelow and an isolation contacts opening control circuit IO therebelow. This control logic also comprises a trip indicator control circuit TIC at the lower portion of FIG. 6*c* for lighting a trip indicator in the form of a light emitting diode LED to indicate that the power controller has tripped open.

At the upper left hand portion of FIG. 6*b* this control logic comprises an instantaneous trip detector ITD which detects that the D.C. line current has risen above rate value such as 100 amps and initiates tripping action. Directly to the right of this instantaneous trip detector at the upper portion of FIG. 6*b*, the control logic comprises a relay open or trip control circuit ROTC. The purpose of this relay open or trip control circuit is to initiate tripping of the power contacts under two conditions, i.e., whenever the control switch is moved from its closed to its open position or whenever the DC line current rises above rated value such as 100 amps. Directly below this relay open or trip control circuit RO-TC in FIG. 6*b* is a reset circuit RC. This reset circuit will reset the output latch of the relay open or trip control circuit RO-TC whenever two states coexist simultaneously, i.e., the control switch must be in the open position and the current across the power contacts must have decreased to a very low value for example to a value less than ½ amp.

In addition, this control logic indicated generally as 12 in FIG. 1 comprises a current and voltage sampling circuit CVSC shown at the central and lower portions of FIG. 6*a* and at the central and lower, left portions of FIG. 6*b*. Voltage sampling circuit VS is shown at the lower right hand portion of FIG. 6*a* and the lower left hand portion of FIG. 6*b* and is capable of sampling the output voltage VF of voltage sensing circuit 32 to determine whether such voltage is more than, for example, 12 volts under one condition or more than, for example, 30 volts under another condition in order to permit interruption of rated current or to permit interruption of a fault current above rated current, respectively, depending on the respectively simultaneous values of current in the D.C. line as hereinafter more fully described. This voltage sampling circuit VS receives a voltage signal VF from voltage sensing circuit 32 through conductor 34 and its outputs are connected through conductors 76 and 78 to current sampling circuits CS of the aforementioned current and voltage sampling circuit CVSC.

This current sampling circuit shown at the midportion of FIG. 6*a* receives an input signal from the current sensing circuit 28 through conductors 30 and 30*a* and its output is conducted through conductor 36 to gate drive circuit 38 as hereinbefore mentioned. For exemplary purposes, this current sampling circuit has been preset to detect whether the D.C. line current is less than 160 amps when interrupting rated current or to detect whether the D.C. line current is less than 300 amps when interrupting fault current above rated current. While the values of current and voltage that are sensed are for exemplary purposes only and may be adjusted to any desired values, generally speaking, under rated current interruption conditions, if the D.C. line current is less than 160 amps and the voltage across the power contacts is more than 12 volts, the current and voltage sampling circuit will provide an output signal on conductor 36 to activate the gate drive circuit 38 and to turn on the power FET's 18–20. On the other hand, if the D.C. power line is to be interrupted at fault conditions above rated current and if the line current is less than 300 amps and the voltage across the power contacts is more than 30 volts, the current and voltage sampling circuit CVSC will provide an output signal on conductor 36 to turn on the power FET's as hereinafter more fully described.

The aforementioned control logic 12 also includes an enabling circuit EC shown in FIG. 6*a* directly above current sampling circuit CS. The purpose of this enabling circuit EC is to gate the output of current and voltage sampling circuit CVSC under certain conditions, namely, the power contacts must have opened and this open state of the power contacts is determined by the nature of the output from relay open or trip control circuit RO-TC at the upper right hand portion of FIG. 6*b*.

The control logic furthermore includes two power-up reset circuits PU1 and PU2 shown at the upper midportion of FIG. 6*b*. The purpose of these power-up reset circuits is to respond to initial connection of power to the system to reset the respective latches at the outputs of relay open or trip control circuit RO-TC and enabling circuit EC.

Figure 8:
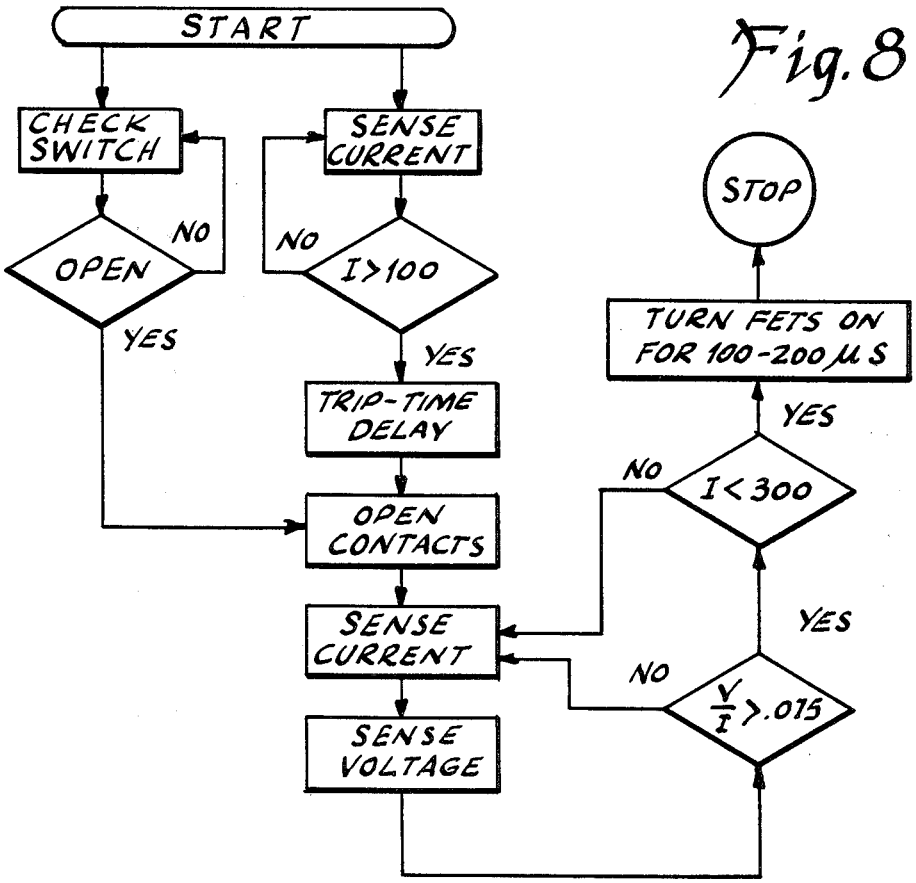
FIG. 8 is a flow chart depicting the function of the hybrid D.C. power controller of FIGS. 1–6.

Before describing in detail the operation of the logic circuit diagram in FIGS. 6*a–c*, reference may be had to the flow chart shown in FIG. 8 for a general view of how the system functions. From the start position in FIG. 8, two routes may be taken. The left hand route is a manual turn-off route and the right hand route is an automatic trip route. Let it be assumed that initially the power contacts are closed and current is flowing. A couple of things must be done. One of them is to "check switch" as indicated by the first manual route step in FIG. 8. If this check indicates that the switch is closed "open-no" which is its current state, nothing further is done. However, if the check indicates that the switch is "open-yes", then the function moves to the "open contacts" step hereinafter described in connection with FIGS. 6*a–c*. The alternative as indicated in FIG. 8 is to "sense current" for automatic trip purposes. If the current value is not greater than some predetermined value that has been preset, "I>100-no" nothing further happens. However, if the current value is greater than a preset trip level, for example, "I>100-yes" amps as indicated in FIG. 8, then the function moves to the "trip-time delay" step. While trip-time delay has been indicated in this flow chart, it will be apparent that either time delayed trip or instantaneous trip could be used and it has been decided to illustrate and describe instantaneous trip in connection with the logic diagram in FIGS. 6*a–c*. Thereafter, the function moves to the next step which is "open contacts" as indicated in FIG. 8. Once the contacts are open, the system senses and samples the current and also senses and samples the voltage as indicated in FIG. 8 to determine whether the ratio of voltage to current is greater than 0.75. This voltage to current ratio of 12/160 or 0.075 has been selected for exemplary purposes. The more general case would be that the ratio of voltage to current should be greater than the resistance of a FET divided by the number of FET's. This ratio of 0.075 corresponds to an exemplary case of four FET's. As indicated in FIG. 8, if this voltage to current ratio is not greater than 0.075, then the function branches back to sensing the current and voltage. On the other hand, if this ratio is greater than 0.075, the system will determine whether the current is less than 300 amps. The reason for this is that if there are four FET's 300 amps is the most that can be put into the four FET's. There might be a case where the current is 1500 amps and where the voltage is high enough to meet the aforesaid ratio but the current is too high. Thus if the current is greater than 300 amps, then it would be necessary to let it continue arcing so as to drive the current down. If the current is not less than 300 amps, then the function in FIG. 8 branches back to continue sensing current and voltage. On the other hand, if it less than 300 amps, the function branches to the next step indicated as "turn FET's on for 100 to 200 microseconds". The time that it is necessary to keep the FET's turned on depends on the particular application as hereinafter described in connection with FIGS. 6*a–c*. After that the arc is extinguished, the FET's may be turned off and any remaining energy is dissipated in energy absorbing device 22 shown in FIG. 1. The flow chart in FIG. 8 then proceeds to the next step which is STOP and that generally completes the function of the system.

The function of the logic diagram in FIGS. 6*a–c* will now be described. As hereinbefore indicated, current flowing in the 270 volt D.C. line shown at the upper left hand portion of FIG. 6*a*, is sensed by a current sensor 24 which may be a Hall effect probe or the like. The output voltage from the probe is proportional to the flux through it. When the probe is placed next to the wire in which the current is flowing, the flux is proportional to the current. The output voltage of the probe is then put through a buffer BF1 to match impendancies or for impendance transfer purposes. This buffer is a standard 3130 operational amplifier or OP AMP and it has a voltage follower configuration so that its output voltage is equal to its input voltage. With no flux through the probe, output voltage VP is equal to ½ the supply voltage for the probe, that is, +V is the control supply voltage and it is indicated at a plurality of points throughout this logic diagram. As the flux to the probe is increased in one direction its output voltage VP drops. On the otherhand, if the flux is changed in the opposite direction, its output voltage goes up. This is a linear relationship. Since D.C. is being sensed, it is necessary to use only ½ of this linear relationship. Since current will flow only in one direction, the flux will change only in one direction. It has been decided to select the relationship wherein as the flux to the probe increases, meaning that more current flows, the output voltage VP of the probe will drop. This output voltage VP of the probe is then applied through buffer BF1 to obtain voltage V2. This voltage V2 is applied to a 3130 OP AMP which is being used as a differential amplifier CPR1. The ratio of resistance (R2/R1) determines the gain of this differential amplifier. As shown in FIG. 6*a*, this voltage V2 is applied to the inverting input of differential amplifier CPR1. A reference voltage for differential amplifier CPR1 is obtained from a potentiometer POT1 through a like buffer BF2. This potentiometer is set so that its output voltage VPO is equal to the probe voltage with no flux through the probe. Thus, voltage VPO equals voltage VP with 0 flux in the probe. Voltage VI on conductor 30 which is the positive output voltage of this current sensing circuit is proportional to the current in the D.C. line.

The current and voltage sampling circuit CVSC shown in FIG. 6*a* will be described next. It will be noted that the output voltage VI of the current sensing circuit is applied from conductor 30 through conductor 30*a* to the two non-inverting inputs of 3130 OP AMPS being used as comparators CPR2 and CPR3 in current sampling circuit CS. Also, the voltage VFET across power contacts 4 in FIG. 1 is applied to input VFET at the lower left hand portion of FIG. 6*a* and therefrom through resistors R5 and R6 to ground. These resistors constitute a voltage divider that divides the voltage down to a workable level that is suitable to the logic following thereafter. A zener diode ZD1 limits the voltage that may be applied to buffer BF3. The output voltage VF of buffer BF3 is a voltage that is proportional to the voltage across the power FET's that are shown in FIG. 1. As shown at the lower portion of FIGS. 6*a* and 6*b*, this voltage VF is applied to the non-inverting inputs of comparators CRP4 and CPR5 in parallel. A potentiometer POT2 is adjusted to apply a voltage indicative of 12 volts across the power FET's to the inverting input of comparator CPR4. In a similar manner, potentiometer POT3 is adjusted to apply a voltage indicative of 30 volts across the power FET's to the inverting input of comparator CPR5. In current sampling circuit CS, a potentiometer POT4 is adjusted to apply a voltage indicative of 160 amps in the line to the inverting input of comparator CPR2 in current sampling circuit CS. In a similar manner, a potentiometer POT5 is adjusted to apply a voltage indicative of 300 amps in the line to the inverting input of comparator CPR3 in current sampling circuit CS.

From the foregoing, it will be apparent that since comparator CPR2 has a reference voltage equivalent to 160 amps in the line, whenever voltage VI, that is, the voltage proportional to the current in the line, is less than 160 amps, the output of comparator CPR2 will be low and the output of inverter I1 will be high which is applied to one of the two inputs of AND logic A1. Also, when buffer BF3 voltage VF which is proportional to the voltage across contacts 4 or the voltage across the power FET's is more than 12 volts, the output of comparator CPR4 will be high and this high is applied through conductor 76 to the other input of AND logic A1. When these states exist simultaneously, AND logic A1 is gated and passes a high through OR logic O1 through one input of AND logic A2.

Alternatively, when voltage VI, which is proportional to the current in the line, is less than 300 amps, the output of comparator CPR3 is low and this low is inverted in inverter I2, to apply a high to one input of AND logic A3. And when voltage VF, which is proportional to the voltage across the power contacts 4, is more than 30 volts, the output of comparator CPR5 is high and this high is applied through conductor 78 to the other input of AND logic A3. The high output of AND logic A3 is then applied through OR logic O1 to one input of AND logic A2.

Now, when it is necessary to interrupt the circuit, something happens that indicates that the contacts should open. This may be done manually or it may be done automatically by short circuit current or overload current such as above rated current as hereinbefore described. At the same time as the contacts are opened, enabling circuit EC in FIG. *6a* is operated to enable the current and voltage sampling circuit CVSC by gating AND logic A2, as hereinafter described in more detail. This allows the voltage and current to be sampled and if the proper conditions occur simultaneously, as hereinbefore indicated, the high input to AND logic A2 provides a high output therefrom, the rising wave front of which triggers monostable multivibrator MMV1, which sends a pulse, as indicated therebelow, through conductor 36 through gate drive circuit 38, thereby to turn all of the power FET's on, such as power FET's 18 and 20 that are across power contacts 4.

As hereinbefore indicated, there are two conditions under which it is desired to turn the power FET's on. In one case, let it be assumed that rated current is being switched. Rated current for this device was assumed as 100 amps. In this case, the peak current that can be put through four power FET's with the minimum arc voltage which is 12 volts would be 160 amps through the four FET's. When the contacts 4 are opened, the system would sample the voltage and current, and if the current is less than 160 amps and the voltage is greater than 12 volts, the power FET's can immediately be turned on. In such case it would not be necessary to allow the contacts 4 to arc any more.

The other case is where there is a short circuit and the current, when the contacts are opened, is 500 to 1500 amps. That's too much for the power FET's to handle. The maximum was heretofore defined as being 300 amps. In this case, the first mentioned criteria would not be met because current is greater than 160 amps, but the second criteria has been set, so that the system would look to see if the current is less than 300 amps. Initially, it won't be because there is a short circuit. As a result, it will be necessary to allow the power contacts 4 to arc for some time so that the current will come down. When the current gets below 300 amps, that is low enough for the power FET's to handle. Then all that is necessary is to make sure that the voltage is great enough to afford a transfer of the current from the contacts to the power FET's. That is, the V over I or voltage over current ratio is right and will meet the second criteria. If the voltage isn't over 30 volts, if the voltage is too low, the current will keep on arcing across the contacts. It is necessary to let the contacts arc until this voltage builds up as it should. As the arc moves out along the arc horn, the voltage will build up. In this case, current comparator CPR3 and voltage comparator CPR5 function and, if the conditions are right, the outputs of comparators CPR3 inverted in inverter I2 and CPR5 gate AND logic A3 to apply a signal to OR logic O1 and AND logic A2 to monostable multivibrator MMV1 as hereinbefore described in the first mentioned state of affairs.

The values given here of 160 amps, 300 amps, 12 volts and 30 volts are not critical and they may be modified as desired as these figures are for exemplary purposes only.

The enabling circuit EC is used to prevent nuisance gating of the power FET's. It will be apparent that the aforesaid combination of states could occur during an open circuit, but it is desirable to limit the gating of the power FET's only when it has been determined that the contacts have been opened. For this purpose, latch LCH1 is used. This latch is set only when the contacts have been opened. And after the current and voltage sampling circuit has operated gate drive circuit 38 to gate the power FET's on, this latch is reset. This resetting is done by the pulse leaving monostable multivibrator MMV1 and which is applied through OR gate O2 to reset terminal R of latch LCH1. The manner in which this enabling circuit is operated, or rather the manner in which latch LCH1 is set, will be described hereinafter.

Latch LCH1 is reset initially by power up circuit PU2 when power is applied to the system. when power is applied initially, it takes time for capacitor C1 to charge so that a high is applied from the upper end of resistor R7 through OR logic O2 to the reset terminal of latch LCH1 to reset this latch. Thereafter, when power comes fully on and capacitor C1 fully charges, the voltage applied from the upper end of resistor R7 to the reset terminal goes low. In this reset state, the Q output of latch LCH1 goes low and disables AND logic A2 so that the power FET's cannot be gated on. All that is needed then to enable the current and voltage sampling circuit is to receive a rising wavefront pulse V3 on conductor 80 to monostable multivibrator MMV2 which as a result will put out a positive pulse to set terminal S of latch LCH1, to set this latch so that Q goes high and gates AND logic A2. These monostable multivibrators MMV1 and MMV2 are the standard 4098 type as are all the other MMV's in this system.

It will be apparent from the foregoing that it is necessary to pulse the power FET's once, and once only. For this reason, monostable multivibrator MMV1 is used so that it puts out only one pulse to the gate drive circuit and at the same time the output of this multivibrator resets latch LCH1 which disables AND logic A2, so that current and voltage sampling circuit CVSC can put out no more pulses.

It will be recalled from the foregoing, that power contacts 4 can be caused to open in either of two ways, that is, either when toggle switch TS is actuated, or when an overcurrent is sensed. Under either of these conditions, relay opening coil ROC, shown at the right central portion of FIG. 6*c*, will be energized to open power contacts 4.

The operation of switch circuit 8 at the upper left hand portion of FIG. 6*c*, will be described first. This circuit comprises toggle switch TS, which is shown in its open position and which may be actuated to its closed position. Positive supply voltage is supplied through parallel resistors R9 and R10 to the two stationary contacts of toggle switch TS whereas the movable contact thereof is connected to ground. These two stationary contacts of toggle switch TS are connected through a debounce circuit to output conductor 10 which has been designated as having a voltage V5 thereon. This debounce circuit consists of a pair of standard 4093 2-input NAND Schmitt trigger logics NA1 and NA2, cross coupled to one another at first inputs thereof and having their other inputs connected to the two stationary contacts of toggle switch TS, and with the output of logic NA2 connected to output conductor 10.

When this switch is in its open position as indicated, and that is the position where the relay contact should be open, this output designated V5 is high. When the toggle switch is in its closed position, this output is low. Now let it be assumed that it is desired to close the relay. There are three possible functions, closing and opening manually and opening automatically. In order to close the relay, it is necessary to move toggle switch TS from its open position to its close position. As a result, the output V5 goes from high to low so that there is a falling pulse edge. This falling edge of pulse will first cause a closing of isolation contacts 2 and thereafter will cause closing of relay contacts 4. This falling pulse edge will be applied through conductor 82 to monostable multivibrator MMV3 to cause the latter to output a positive pulse as indicated adjacent thereto. This positive pulse from monostable multivibrator MMV3 will gate field effect transistor FET3 to turn it on, and thereby energize isolation closing coil ICC. A zener diode ZD2 is connected across field effect transistor FET3 to shunt excessive voltage therefrom and thereby protect it. The aforementioned falling edge of pulse V5 is also applied through a delay monostable multivibrator MMV4 to provide a positive pulse therefrom as depicted adjacent thereto. The trailing edge of this pulse which is a falling characteristic is applied to monostable multivibrator MMV5 to cause a positive pulse to be applied therefrom to one input of AND gate A4. This positive pulse on one input of AND gate A4 will gate the same provided that there is a high on its other input which comes about as follows. It may be assumed that the output V3 from relay open or trip control circuit RO-TC on conductor 84 is low, and that this low is inverted in inverter I3 to a high which is applied to the other input of AND logic A4. Therefore, the pulse coming from monostable multivibrator MMV5 is gated through and is applied to gate field effect transistor FET4 on so as to energize relay closing coil RCC. A zener diode ZD3 is connected across field effect transistor FET4 to shunt excessive damaging voltage therefrom and thereby protect the same.

It will be apparent from the foregoing that both the isolation contact closing coil ICC and the relay closing coil RCC are pulsed. It is only necessary to pulse these coils and thereafter when the pulse ends and the coil de-energizes, the contacts in both cases remain closed.

It will be recalled from the foregoing that the voltage V5 which was used to pulse the closing coils is low and that this voltage V5 is applied through conductor 86 to one input of OR logic O4 at the upper portion of FIG. 6*b*. This low will have no effect on the circuit there because monostable multivibrator MMV6 requires a rising pulse for operation thereof. Also, voltage VI which is proportional to the line current on conductor 30 in FIG. 6*a* is applied through conductor **30*b* to the noninverting input of comparator CPR6. Potentiometer POT6 is adjusted so that a voltage proportional to 100 amps on the power line is applied to the inverting input of comparator CPR6. Since, under normal conditions, the input voltage VI to instantaneous trip detector ITD is proportional to less than 100 amps on the power line, the output of comparator CPR6 will be low. This low also will have no effect on relay open or trip control circuit RO-TC because monostable multivibrator MMV6** requires a rising pulse for operation thereof.

When power was first applied to the system, power-up reset circuit PU1 in FIG. 6*b* functioned to reset latch LCH2. This latch is reset in the same manner as previously described in connection with latch LCH1 in that a high is first applied from the upper end of resistor R8 through OR logic O3 to the reset terminal of latch LCH2 to reset the same. As a result, the Q output of latch LCH2 goes low. After capacitor C2 charges, the voltage from the upper end of resistor R8 drops low so that latch LCH2 is in a condition so that it can be set at any time.

There will now be described the case, where the relay is opened manually. For this purpose, it is necessary to actuate toggle switch TS in FIG. 6*c* from its close position to its open position. For reasons hereinbefore described, this causes voltage V5 at output conductor 10 of the debounce circuit to go from low to high. This high is applied through conductor 86 to one input of OR logic O2 in relay open or trip control circuit RO-TC at the upper portion of FIG. 6*b*. Since this voltage V5 went from low to high, that is, has a rising pulse front, it triggers monostable multivibrator MMV6 to cause the latter to output a positive pulse V2 to set latch LCH2. As a result, the Q output of this latch goes from low to high. This high output voltage V3 is applied through conductor 84 to perform a number of functions. First, this high is inverted to a low in inverter I3 to shut AND gate A4 so that the relay closing coil cannot be pulsed. Secondly, this rising pulse triggers monostable multivibrator MMV7 to cause the latter to output a pulse to gate field effect transistor FET5 and turn it on to pulse and thereby energize relay opening coil ROC. A zener diode ZD4 is connected across field effect transistor FET5 to protect the same from excessive voltage. Thirdly, the rising pulse on conductor 84 triggers delay monostable multivibrator MMV8, to cause the latter to output a positive pulse as depicted adjacent thereto. The trailing edge of this positive pulse triggers monostable multivibrator MMV9 to cause the latter to output a delayed pulse to gate field effect transistor FET6 to cause isolation contact opening coil IOC to be pulsed, thereby to open contacts 2 in a delayed manner after contacts 4 have been opened. A zener diode ZD5 is connected across field effect transistor FET6 to protect the latter from excessive voltage. Fourthly, voltage V3 on conductor 84 is applied back through conductor 80 to enabling circuit EC in FIG. 6*a*. This rising pulse V3 triggers monostable multivibrator MMV2 to cause the latter to output a positive pulse as depicted immediately adjacent thereto, thereby to set latch LCH1, causing its Q output to go from low to high. This high gates AND logic A2 and thus enables current and voltage sampling circuit CVSC so that it can sample the current and voltage and gate the power FET's on at the appropriate time since power contacts 4 are now open. The power FET's then conduct the current for a predetermined time whereafter the power FET's are turned off. Any remaining energy is then absorbed in energy absorber 22 shown in FIG. 1. The timing is such that the DC line circuit is completely interrupted by power contacts 4, the power FET's and energy absorber 22 before isolating contacts 2 open. Gate drive voltage VGD is also applied from the output of monostable multivibrator MMV1 through OR gate O2 to reset latch LCH1.

When the current is being interrupted as aforesaid and the current decreases to a very low value such as less than ½ amp, latch LCH2 in relay open or trip control circuit RO-TC is reset. This comes about in the following manner. Potentiometer POT7 in reset circuit RC at the upper portion of FIG. 6*b* is adjusted so that the voltage applied to the inverting input of comparator CPR7 is the equivalent of substantially ½ amp of current in the power line. Thus, when the current decreases to less than ½ amp and the voltage VI indicative of this is applied to the noninverting input of comparator CPR7, the output of the latter goes low. This low is inverted to a high in inverter I4 which is applied to one input of AND logic A5 while the other input thereof is receiving a high from conductor 86 which is voltage V5 at the output of switch circuit 8 in FIG. 6*c*. As a result, AND logic A5 outputs a rising pulse to monostable multivibrator MMV10 which in turn outputs a positive pulse through OR logic O3 to the reset terminal of latch LCH2. Now the power line has been interrupted completely and the logic circuit has been reset preparatory to performing some other function.

Now, let it be assumed that there is a fault in the system such that the current in the 270 volt DC power line goes above rated value, that is, above 100 amps. This will cause an instantaneous trip as hereinafter described. Under this condition, toggle switch TS at the upper left hand portion of FIG. 6*c* is closed so that voltage V5 on conductor 10 at the output of switch circuit 8 is low. When the current in the line goes above 100 amps, voltage VI at the output of current sensing circuit 28 in FIG. 6*a* will rise above the voltage of potentiometer POT6 and will cause comparator CPR6 to be triggered so that its output will go high. This high comparator output will be applied through OR logic O2 to trigger monostable multivibrator MMV6. This monostable multivibrator will output a positive pulse V2 which will set latch LCH2 causing its output voltage V3 to go high. This high will be applied through conductor 84 to pulse the relay opening coil ROC and to open contacts 4 as hereinbefore described. The current and voltage sampling circuit CVSC will then sample the voltage and current in order to decide when to turn the power FET's on that are across contacts 4 and the system goes through the same sequence of interruption as hereinbefore described when the interruption was accomplished by manual control at toggle switch TS.

This state of affairs will cause the trip indicator shown at the lower portion of FIG. 6*c* to light to indicate that the circuit has tripped open. For this purpose, the high output voltage V3 of latch LCH2 is applied through conductor 84 also to the upper input of AND logic A6 at the lower left hand portion of FIG. 6*c*. The low voltage V5 from the output of switch circuit 8 is applied through conductors 86 and 88 and inverted to a high in inverter logic I5 which high is then applied to the other input of AND logic A6. As a result, the high output of AND logic A6 gates field effect transistor FET7 to ignite light emitting diode LED thereby to indicate that the circuit has tripped.

When the current in the line decreases below ½ amp, comparator CPR7 in reset circuit RC at the upper portion of FIG. 6*b* triggers low so that the output of inverter I4 goes high which is applied to one input of AND logic A5. However, the other input of AND logic A5 is receiving a low voltage from conductor 86 so that latch LCH2 will not be reset. Thus, voltage V3 on conductor 84 remains high and voltage V5 on conductors 86 and 88 remains low so that the trip indicator remains on as long as toggle switch TS remains in its close position.

When toggle switch TS is actuated to its open position, voltage V5 goes high. As a result, the output of inverter I5 at the lower left hand portion of FIG. 6*c* goes low to cause trip indicator LED to go off. Voltage V5, which is high, is also applied to the upper input of AND logic A5 in reset circuit RC to cause operation of monostable multivibrator MMV10 and consequent resetting of latch LCH2, thereby causing voltage V3 to go low. It will be apparent from the foregoing that in order to reset latch LCH2, it requires not only toggle switch TS to be in the open position but also the current in the line must have decreased below ½ amp in order to gate AND logic A5. This logic circuit inhibits pulsing of the relay closing coil RCC and closing contacts 4 if conditions are not right. For example, if toggle switch TS is actuated from its open to its close position while latch LCH2 has not been reset, the relay closing coil cannot be pulsed. This is for the reason that the high voltage V3 is applied through conductor 84 and inverted to a low in inverter I3 so that AND logic A4 will not be gated. Thus, even if the low transistion voltage V5 is applied through monostable multivibrators MMV4 and MMV5 to pulse AND logic A4, that pulse will not go through. Therefore, if latch LCH2 has not been reset, the relay cannot be closed. This indicates that there is some kind of a problem. Either the current is too high, that is, it is still arcing for some reason, a very long, low level arc, or there may be a problem in the circuitry. Voltage V3 at the output of latch LCH2 is a controlling point, and if this latch does not get reset, as it should, it does not allow the circuit to be closed again.

While a number of gate drive circuits for the power FET's 18 and 20 shown in FIG. 1 may be used, the version 38 shown in FIG. 6*b* has been illustrated for examplary purposes. A high voltage on input conductor 36 turns this gate drive circuit on so that a high output appears at output terminal 39. This circuit comprises five field effect transistors, four of which 90, 91, 92 and 93 are of the type that require a high gate voltage to turn them on, whereas field effect transistor 94 is of the type that requires a low voltage to turn it on, as indicated by the arrows thereon. When a high "on" input voltage is applied from conductor 36 to this gate drive circuit, field effect transistors 90, 91 and 94 turn on, whereas field effect transistors 92 and 93 turn off. Therefore, a high voltage is applied from plus V through field effect transistor 94 to output terminal 39.

On the other hand when the input voltage on input conductor 36 goes low, field effect transistors 90, 91 and 94 turn off and field effect transistors 92 and 93 turn on. As a result, low voltage is applied from ground through field effect transistor 93 to output terminal 39.

While the foregoing description has been devoted to interrupting the power line, the logic circuit shown in FIGS. 6*a–c* also has provisions for arcless closing of the power line. For this purpose, voltage V5 at the output of switch circuit 8 in FIG. 6*c* which is a high-to-low transition when the switch TS is closed, triggers monostable multivibrator MMV11 which outputs a positive pulse. This positive pulse is applied through conductor 96 and OR logic O5 in FIG. 6*b* to gate drive circuit 38. As a result, the power FET's across power contacts 4 are turned on for substantially three milliseconds which covers the contact bounce period of contacts 4. Thus, each time the power contacts are closed, the power FET's shunt the arc therefrom for arcless closing of the power line.

It will be apparent from foregoing that there has been provided a combination of structures and control logic that effectively interrupts a high voltage high current DC power circuit. The relay shown in FIG. 2 has been constructed so that the double break contacts open fast, that is, they will separate consistently within a short time such as two milliseconds after receiving the opening signal from the control circuit. This structure provides arc horns, field amplifliers and arc splitter plates to facilitate the build-up of arc voltage during short circuit or other interrupting conditions. These features are necessary for high current interruption at low pressure since the initial high current needs to be reduced to such a value that can be safely handled by the power FET's that are connected across contacts 4. Contact 2 is timed to open at about 30 milliseconds after the opening of the main contacts 4.

While the apparatus hereinafter described is effectively adapted to fulfill the objects stated, it is to be understood that the hybrid DC power controller is not intended to be confined to the particular preferred embodiment disclosed, inasmuch as it is susceptible of various modifications without departing from the scope of the appended claims.

We claim:

1. A D.C. power controller for effectively interrupting a high voltage high current D.C. power line supplying a load from a D.C. power supply source comprising:

power contacts in said power line;

operating means for said power contacts;

arc control means associated with said power contacts;

and control means comprising:

a plurality of arc-shunting solid state elements connected in parallel across said power contacts;

means for controlling said operating means to open said power contacts;

means for sampling the power line current and the voltage across said open contacts to determine when said current has decreased to a value that can be conducted by said solid state elements and said voltage has increased to a value capable of effecting transfer of the arcing current from said power contacts to said solid state elements;

means for allowing said power contacts to arc until said values of current and voltage are reached;

and means thereupon operable to gate said solid state elements to divert the arcing current from said contacts thereby to afford effective and repeated interruption of said power line by use of a minimum number of said solid state elements in combination with said power contacts for power interruption control.

2. The D.C. power controller for effectively interrupting a high voltage D.C. power line supplying a load from a D.C. power supply source claimed in claim 1, wherein:

said values of current and voltage that are to be reached are defined as the ratio of voltage to current must be greater than the resistance of one of said solid state elements divided by the number of said solid state elements used.

3. A D.C. power controller for rapidly and effectively interrupting a high voltage high current D.C. power line in a low atmospheric pressure environment such as is present at high altitudes comprising:

contact means comprising power contacts in said power line;

operating means for said power contacts;

an arc horn for said power contacts;

a magnetic field amplifier for said power contacts and said arc horn;

one of said power contacts being configured to conduct current in a loop to energize said magnetic field amplifier and thereby cause an arc to move from said power contacts along said arc horn;

an arc splitter for receiving and acting on the arc as it moves along said arc horn and comprising spaced insulated electrically-conductive plates for splitting the arc;

a housing enclosing and supporting the aforementioned parts;

gas-ablating electrically-insulating material lining the surfaces exposed to the arc except said contacts, arc horns and splitter plates to provide an atmosphere conducive to movement of the arc;

and control means comprising:

controllable arc-shunting means across said power contacts;

means for controlling said operating means to open said power contacts;

means for sampling the power line current and the voltage across said open power contacts to determine when said current is below a given current value and said voltage is above a given voltage value;

means for allowing said power contacts to arc until said given current and voltage values are reached or exceeded;

and means thereupon operable for turning said controllable arc-shunting means on to divert the current from arcing across said contacts.

4. The D.C. power controller claimed in claim 3, wherein said control means also comprises:

means for sensing the current in said power line and providing a signal proportional thereto;

and means responsive to said signal when the power line current has decreased below a predetermined low value for turning said controllable arc-shunting means off.

5. The D.C. power controller claimed in claim 4, wherein said control means also comprises:

an energy absorbing device connected across said controllable arc-shunting means for dissipating any remaining energy when the latter are turned off.

6. The D.C. power controller claimed in claim 3, wherein:

said contact means also comprises isolating contacts in said power line for completely disconnecting said controllable arc-shunting means from the power to prevent any current leakage therethrough.

7. The D.C. power controller claimed in claim 3, wherein said control means also comprises:

means operable when said power contacts are closed for turning said controllable arc-shunting means momentarily on long enough to shunt any arcs due to contact bounce.

8. A hybrid D.C. power controller for interrupting a high voltage D.C. power line in a low pressure environment comprising:

contacts in said power line;

actuating means for closing and opening said contacts to respectively complete and interrupt said power line;

an arc horn extending from said contacts for stretching an arc thereacross as it moves along said arc horn toward its outer end;

a magnetic field amplifier embracing said contacts and at least a portion of said arc horn for providing an amplified magnetic field to move the arc along said arc horn toward its outer end;

a gas ablating electrically-insulating cover lining portions of said field amplifier that are exposed to the arc when said contacts are opened;

an arc splitter for receiving the arc as it moves toward said outer end of said arc horn, said arc splitter comprising a plurality of spaced electrically conductive plates held in a gas-ablating electrically-insulating retainer;

a housing enclosing and mounting the aforementioned parts;

gas-ablating electrically-insulating members sandwiching the portions of said arc horn between and about said field amplifier and said arc splitter therebetween;

and control means comprising:

on-off controllable arc shunting means connected across said contacts;

means for sensing the current in said power line and providing a current signal proportional thereto;

means for controlling said actuating means to open said contacts;

means for sensing the voltage across said contacts when said contacts are opened and providing a voltage signal proportional thereto;

means responsive to the ratio of said voltage signal to said current signal passing a predetermined value provided said current is below another predetermined value for turning said arc-shunting means on thereby to shunt the arc from said contacts;

and means operable when the current in said power line has decreased below a further predetermined value for turning said arc-shunting means off thereby to interrupt said power line.

9. The hybrid D.C. power controller claimed in claim 8, wherein:

said means for controlling said actuating means to open said contacts comprises:

a close-open switch;

means responsive to operation of said switch to its open position for controlling said actuating means to open said contacts.

10. The hybrid D.C. power controller claimed in claim 8, wherein:

said means for controlling said actuating means to open said contacts comprises:

an instantaneous trip detector responsive to said current signal when the current in the power line exceeds a predetermined excessive value for providing a trip control signal;

and means responsive to said trip control signal for controlling said actuating means to open said contacts.

11. The hybrid D.C. power controller claimed in claim 10, wherein said predetermined excessive value of current is a power line current above rated value.

12. The hybrid D.C. power controller claimed in claim 10, wherein said predetermined excessive value of current is an overload current value.

13. The hybrid D.C. power controller claimed in claim 8, wherein:

said on-off controllable arc shunting means comprises one or more power field effect transistors, each connected across said contacts, and the number, size and rating thereof used in a given application being dependent upon the magnitude of current to be shunted from the contacts which are minimized by allowing said contacts to arc until optimum values of voltage and current are reached.

14. The hybrid D.C. power controller claimed in claim 8, wherein:

said means responsive to the ratio of said voltage signal to said current signal passing a predetermined value provided said current is below another predetermined value for turning said arc shunting means on comprises:

means operable when interrupting rated current for sampling the current and voltage to determine when the power line current is below a given current value and the voltage across the contacts is above a given voltage value and for turning said arc-shunting means on;

and means operable when interrupting fault current above rated current for sampling the current and voltage to determine when the power line current is below a higher given current value and the voltage across the contacts is above a higher given voltage value and for turning said arc-shunting means on.

15. A hybrid D.C. power controller for rapidly and effectively interrupting a high voltage D.C. power line in a low atmospheric pressure environment such as is present at high altitudes comprising:

contact means comprising double-break power contacts including two stationary contacts and a movable bridging contact in said power line;

operating means for said power contacts;

a pair of arc horns with one for each side of said double-break contacts;

a pair of magnetic field amplifiers with one for each side of said double-break contacts and the associated arc horn;

each said stationary contact being formed to conduct current in a loop so as to energize the respective field amplifier and thereby cause an arc between said stationary contact and said movable bridging contact to move therefrom along the respective arc horn;

a pair of arc splitters with one for each of said arc horns for receiving and breaking up the arc as it moves along the respective arc horn and each comprising spaced insulated electrically-conductive plates for breaking up the arc;

a housing enclosing and supporting the aforementioned parts;

gas-ablating insulating material lining the surfaces exposed to the arcs except said contacts, arc horns and splitter plates to provide an atmosphere conducive to movement of the arc;

and control means comprising:

controllable turn-on turn-off arc-shunting elements in parallel across said stationary contacts;

means for controlling said operating means to actuate said movable bridging contact to disengage said stationary contacts;

means for sampling the voltage across the open power contacts and the power line current to determine when said current is at a value that can be conducted by said arc-shunting elements and when the ratio of said voltage to said current is proportional to the resistance of one of said elements divided by the number of said elements used;

means allowing said power contacts to arc until said current value and said ratio is reached;

and means thereupon operable for turning said elements on to divert the current from the arcing contacts.

16. The hybrid D.C. power controller claimed in claim 15, wherein:

said control means also comprises means responsive to the current in said power line decreasing to a predetermined low value for turning said elements off.

17. The hybrid D.C. power controller claimed in claim 16, wherein:

said contact means also comprises isolating contacts in said power line for completely disconnecting said elements from the power to prevent any current leakage therethrough after they are turned off;

and said control means also comprises means for opening said isolating contacts last with time delay and closing the same first relative to said power contacts.

18. The hybrid D.C. power controller claimed in claim 15, wherein:

said means for controlling said operating means to actuate said movable bridging contact to disengage said stationary contacts comprises:

a manual switch having a close position and an open position;

and said control means comprises:

means normally responsive to movement of said switch to its close position for activating said operating means to close said power contacts and normally responsive to movement of said switch to its open position for activating said operating means to open said power contacts;

and means for inhibiting said activation of said operating means to close said power contacts if the current in said power line has not decreased to a predetermined low value.

19. A D.C. power controller for effectively interrupting a high voltage high current D.C. power line supplying a load from a D.C. power supply source without the help of any controllable arc-shunting elements across the power contacts comprising:

at least one stationary contact;

a movable contact;

an arc horn extending away from said contacts;

a magnetic field amplifier spanning opposite sides of said contacts and at least the initial portion of said arc horn where it extends away from said contacts;

said stationary contact being configured to provide a loop of current flow for energizing said magnetic field amplifier;

an arc splitter associated with said arc horn and having plates to receive a moving arc therein;

a housing supporting and enclosing the aforementioned parts;

and gas-ablating insulating material lining the surfaces between and about said magnetic field amplifier and said arc splitter exposed to the arc except said contacts, said arc horn and said arc splitter plates.

* * * * *